US005187951A

United States Patent [19]

Stroud et al.

[11] Patent Number: 5,187,951

[45] Date of Patent: Feb. 23, 1993

[54] CIRCULAR KNITTING MACHINES

[75] Inventors: Edward C. Stroud, Kenilworth; John D. Griffith, Sunderland, both of England

[73] Assignee: Bentley Group Limited, Leicester, England

[21] Appl. No.: 725,792

[22] Filed: Jul. 9, 1991

[30] Foreign Application Priority Data

Jul. 10, 1990 [GB] United Kingdom ..... 9015204

[51] Int. Cl.[5] ..... D04B 9/10; F01B 7/00

[52] U.S. Cl. ..... 66/14; 92/62

[58] Field of Search ..... 66/7, 14, 17, 27, 55; 92/62

[56] References Cited

U.S. PATENT DOCUMENTS

| | | | |
|---|---|---|---|
| 1,778,974 | 10/1930 | Grieve | 66/14 |
| 3,324,684 | 6/1967 | Paepke | 66/14 |
| 3,564,869 | 2/1971 | Plath | 66/14 |
| 4,186,649 | 2/1980 | Sundstrom | 92/62 X |
| 4,502,299 | 3/1985 | Keel et al. | 66/14 X |

FOREIGN PATENT DOCUMENTS

| | | |
|---|---|---|
| 0310845 | 4/1989 | European Pat. Off. . |
| 1079782 | 4/1960 | Fed. Rep. of Germany . |
| 2002568 | 8/1971 | Fed. Rep. of Germany . |
| 2260666 | 6/1974 | Fed. Rep. of Germany . |
| 2906916 | 7/1980 | Fed. Rep. of Germany . |
| 2086311 | 5/1982 | United Kingdom . |
| 2058152 | 7/1983 | United Kingdom . |

*Primary Examiner*—Peter Nerbun
*Assistant Examiner*—John J. Calvert
*Attorney, Agent, or Firm*—Dann, Dorfman, Herrell and Skillman

[57] ABSTRACT

A cam actuator for selectively moving cam elements axially between distinct operative positions in a circular knitting machine, the actuator including a series of adjacent pistions arranged along the axial line of displacement, and stop means for limiting the axial stroke of each piston in the direction of extension. Each piston co-operates with adjacent pistons in the series such that displacement of a given piston in the extend direction causes the remaining pistons located between the cam element and the given piston to be displaced in the extend direction by the stroke length undergone by the given piston.

10 Claims, 6 Drawing Sheets

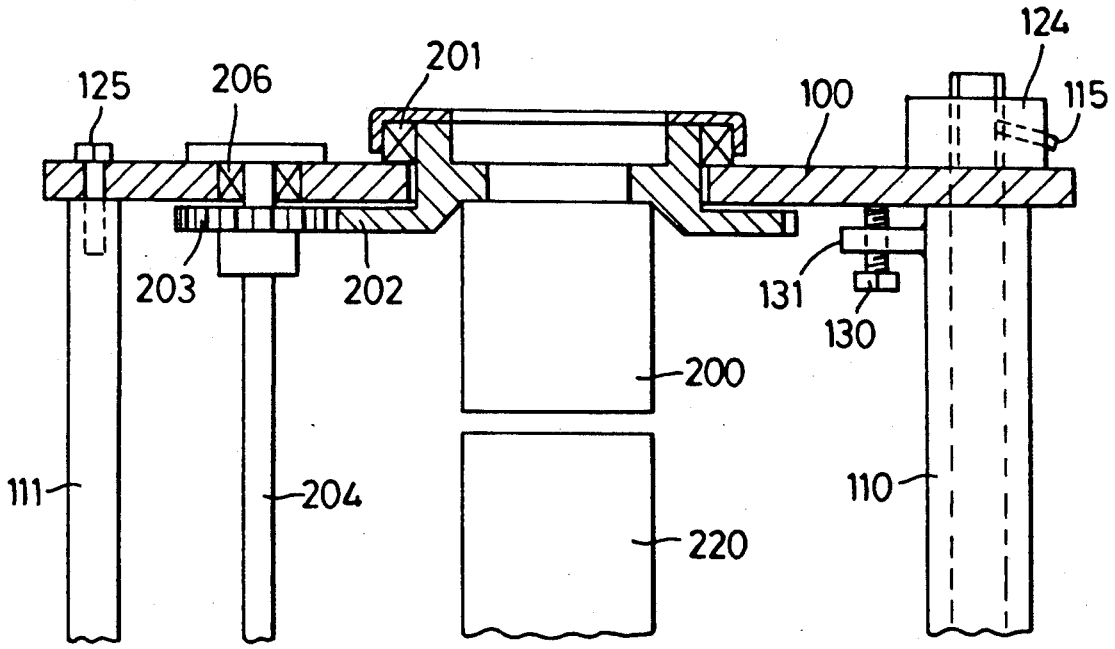
Fig. 3
Fig. 4
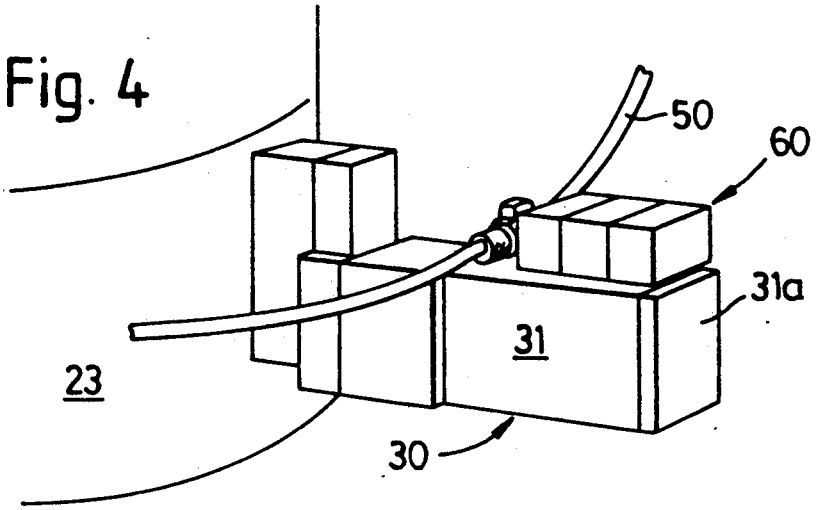

CIRCULAR KNITTING MACHINES

FIELD OF THE INVENTION

The present invention relates to a circular knitting machine and to electronically controlled actuation devices for such machines.

BACKGROUND OF THE INVENTION

In particular, the present invention relates to a double cylinder type circular knitting machine.

In such knitting machines a double ended knitting needle is used which during knitting can be transferred between the upper and lower needle cylinder assemblies. Such machines are commonly used for knitting of hosiery and/or knitwear and during each knitting cycle the selected needles will undergo various motions such as knit, miss, tuck or transfer between cylinder assemblies. These motions are imparted to the needles by sliders which have butts running along tracks in upper and lower cam assemblies associated with the upper and lower cylinder assemblies respectively.

Actuators are provided which move cam elements such as for example bolt cams in the cam assemblies for altering the path of travel followed by the butts of the sliders and thereby alter the motion undergone by the needles controlled thereby. Normally these actuators are mechanically operated from a cam drum assembly which is driven by the main drive shaft of the knitting machine via a timing transmission which normally comprises a timing chain which is indexed by a pawl mechanism.

Since a separate cam wheel is required for each actuator a large number of cam wheels have to be provided. In addition a large number of rods, cables etc. for transmitting drive from the cam followers to the components to be actuated need to be provided also. Accordingly the conventional construction of providing cam wheel assemblies for operating cam element actuators has inherent disadvantages; for example flexibility of control is restrictive since to change sequences of operation requires time consuming modification to the timing chain and/or the cam wheels. In addition the provision of a large number of mechanical components around the upper and lower cylinder assemblies not only restricts access to the cylinders and associated cam assemblies but also imposes the need to continually lubricate and/or service the mechanical linkages.

An advantage of using a cam drum assembly for operating cam elements is that positive positional control under adequate power is provided for moving the cam element into and out of cam tracks in the cam assemblies. This is particularly so for cam elements which need to be accurately located a several distinct positions when being inserted into or retracted from a cam track. For instance in the cam assembly associated with the lower cylinder of a double cylinder circular knitting machine adapted for knitting half hose having a heel pouch it is necessary for a cam element to be positioned at 4 discrete positions, viz a fully retracted position whereat it does not co-operate with butts on any needle slider, a fully inserted position whereat it co-operates with butts on all needle sliders and two intermediate positions whereat it co-operates with butts of selected needle sliders having a predetermined butt height.

In view of this multi-stage positioning and power capability provided by actuators operated by a cam wheel assembly such assemblies have remained in common usage despite the disadvantages exemplified above.

SUMMARY OF THE INVENTION

A general aim of the present invention is to provide an electronically controlled actuator which possesses the advantage of providing multi-stage positioning with adequate power as associated with mechanically operated actuators and which overcomes or substantially reduces the disadvantages exemplified above. Accordingly, an actuator according to the present invention can be used as a direct substitution of a cam wheel driven actuator and thereby can be used to actuate cam elements without requiring modification of the cam assembly.

According to one aspect of the present invention there is provided a double cylinder knitting machine comprising a lower cylinder assembly mounted on a lower platform and an upper cylinder assembly mounted on an upper platform, the upper platform being movably mounted on the lower platform for movement between a lowered operative position whereat the upper and lower cylinder assemblies co-operate for knitting and a raised in-operative position whereat the upper and lower cylinder assemblies are separated.

According to another aspect of the present invention there is provided a cam actuator for selectively moving cam elements between distinct operative positions, the actuator including a series of adjacent pistons arranged along the axial line of displacement, stop means for limiting the axial stroke of each piston in the direction of extension, each piston co-operating with adjacent pistons such that displacement of a given piston in the extend direction causes the remaining piston or pistons in the series located between the cam element and the given piston to be displaced in the extend direction by the stroke length undergone by the given piston.

According to another aspect of the present invention there is provided a yarn feeder for a knitting machine, the feeder including a plurality of yarn guide fingers pivotally mounted to describe an arc of movement to move between a rest position, a feed position and a park/cross-over position, each yarn finger being deflected through said arc and positioned at one of said positions by means of a first piston acting on a pivoted lever on which the finger is mounted, the first piston being arranged to move the finger from one end of the arc of movement to the other, a two position stop means, preferably in the form of a second piston, acting on the lever to arrest movement of the lever caused by the first piston at an intermediate position along the arc and at said other end of the arc.

BRIEF DESCRIPTION OF THE DRAWINGS

Various aspects of the present invention are hereinafter described with reference to the accompanying drawings in which:

FIG. 3 is a part sectional view of the upper part of the machine, taken along line III—III in FIG. 1 with the majority of the upper cylinder assembly removed for clarity;

FIG. 4 is a perspective view of an electronically controlled actuator according to the present invention;

DESCRIPTION OF PREFERRED EMBODIMENT

Figure 1:
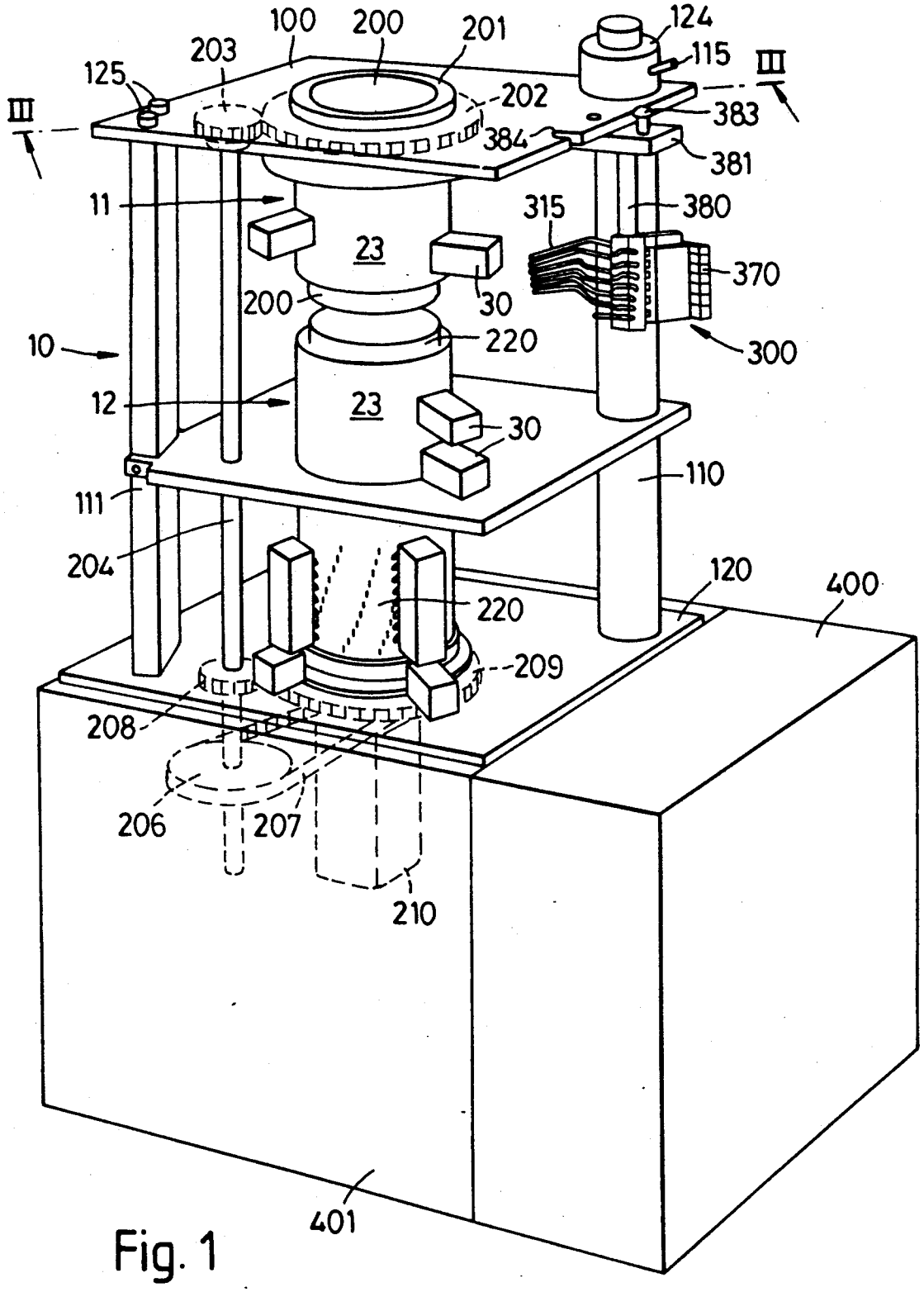
FIG. 1 is a schematic perspective view of a double cylinder circular knitting machine according to the present invention.
Figure 2:
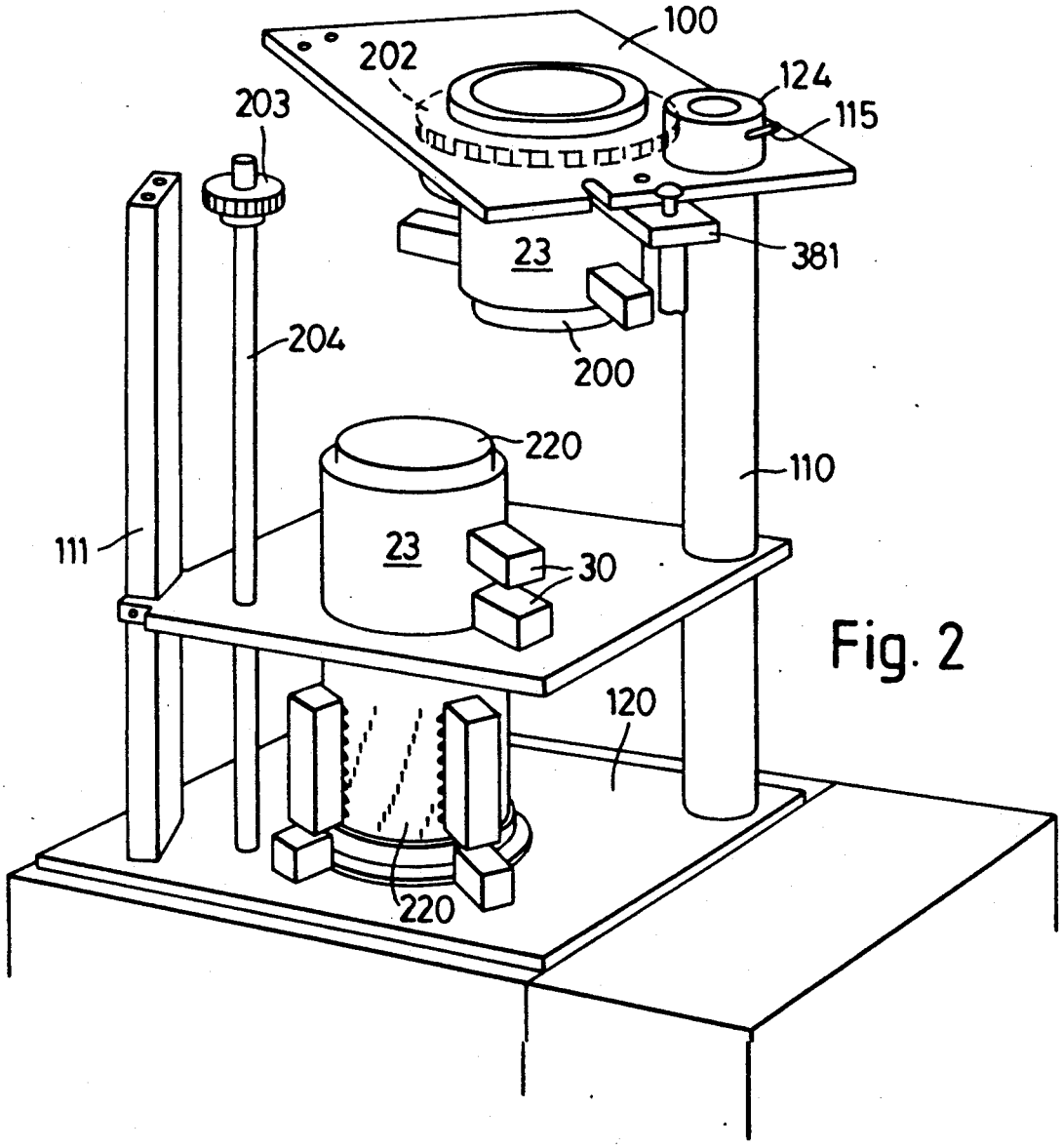
FIG. 2 is a view similar to FIG. 1 in which the upper cylinder assembly and associated components have been repositioned.

A double cylinder knitting machine 10 according to the present invention is schematically illustrated in FIGS. 1, 2 and 3.

The knitting machine 10 includes an upper needle cylinder assembly 11 and a lower needle cylinder assembly 12 which are generally of conventional construction. The cylinder assemblies are of the type having stationary cam assemblies 23 which surround the associated needle cylinder. In FIG. 1, the upper needle cylinder is shown as 200 and the lower needle cylinder is shown as 220. A typical machine of this type is one manufactured by Bentley Group Limited and sold under the brand name Komet.

As seen in FIGS. 1 and 2, the upper cylinder assembly is mounted on a support platform 100. The support platform 100 is in turn supported on a base 120 of the machine by a pair of columns 110,111.

As seen more clearly in FIG. 3 the upper needle cylinder 200 is rotatably supported on the platform 100 via a bearing assembly 201. The cylinder 200 is provided with a gear 202 which meshes with a drive gear 203. The drive gear 203 is mounted on a drive shaft 204 which extends from the support platform 100 to the base 120. The drive shaft 204 has a toothed wheel 206 which is driven by a motor 210 via a toothed belt 207. The shaft 204 also has mounted thereon the drive gear 208 which drives a gear 209 mounted on the lower cylinder 220. The drive transmission between motor, upper and lower cylinders (which is shown only diagrammatically in FIG. 1) is synchronised such that the upper and lower cylinder are driven at the same speed and in the same direction at all times.

The drive motor 210 is preferably a brushless DC type motor whose speed and direction of rotation can be accurately electronically controlled.

A yarn feeder unit 300 is provided at each knitting station and each yarn feeder unit is mounted onto the platform 100 either directly as shown or, alternatively, indirectly via the upper cam assembly housing. Each yarn feeder unit 300 is electronically operated and a suitable unit 300 is described below.

The platform 100 is rotatably and slidably attached to column 110 and is detachably attached to column 111. Accordingly the platform is movably mounted for movement between a knitting operative position (as shown in FIG. 1) whereat the upper cylinder assembly 11 is aligned with the lower cylinder assembly 12 for knitting and a knitting inoperative position (as shown in FIG. 2) whereat the upper cylinder assembly is removed from the lower cylinder assembly to thereby permit clear access to the interior of the lower cylinder assembly. Such movement is possible since there are no mechanical linkages extending from the upper cylinder assembly 11 to the base 120. In addition the drive transmission between shaft 204 and the upper cylinder 200 includes drive separation means adapted to be axially separable on raising of platform 100. In this respect, in the illustrated embodiment of the drive separation means is defined by the end of shaft 204 being arranged to be axially withdrawable from the inner race of bearing 206 such that on raising of the platform 100 shaft 204 slides out of bearing 206. All electrical wires for controlling the cam element actuators and yarn feeders are preferably fed to the base 120 via column 110. Preferably column 110 is hollow so as to provide an internal passageway for running of the electrical wires and pneumatic air supply pipes.

The platform 100 is preferably secured to column 110 via a support sleeve 124 which is rotatably and slidably received on the column 110. A locking bolt 115 is conveniently provided to serve as locking means for fixedly securing the sleeve 120 to the column 110 when the platform 100 is located at the knitting operative position.

Similarly, locking bolts 125 are provided for securing the platform 100 to column 111 when in the knitting operative position. Accordingly, during the normal knitting operation, the platform is securely located in the knitting operative position.

When it is necessary to move the platform 100 to the knitting inoperative position, bolts 125 are removed and bolt 115 is released.

It is now possible to raise platform 100 relative to the base 120 so as to axially separate the upper and lower cylinder assemblies by a sufficient distance to enable the platform 100 to be rotated to its knitting inoperative position. Advantageously, lifting means are provided for raising the platform 100. In the illustrated embodiment the lifting means comprise a bolt 130 passing through an arm 131 secured to the column 110; the terminal end of the bolt engaging with the underside of platform 100.

It is envisaged that the electronic control components, eg., the micro processor and related hardware, can be housed in a modular housing 400 which is attached to the main housing 401 of the knitting machine.

The drive shaft of the knitting machine is provided with appropriate sensors to determine the sequence of a knitting cycle.

As indicated above the upper cylinder assembly includes an upper cam assembly 23 for controlling movement of an upper slider for each needle and the lower cylinder assembly includes a first cam assembly for controlling movement of a lower slider for each needle and a second cam assembly for controlling raising/lowering of an intermediate tippable jack which is positioned between a pattern selector jack and the lower slider of each needle.

The cam assemblies include retractable cam elements 21 (see FIG. 5), for example, plunger-type bolt cams which are movable in an axial line between various extended or retracted positions to influence movement of butts of sliders or jacks running therealong.

In accordance with the present invention pneumatically powered actuators 30 are provided which move the bolt cams 21 between their operative positions.

Figure 5:
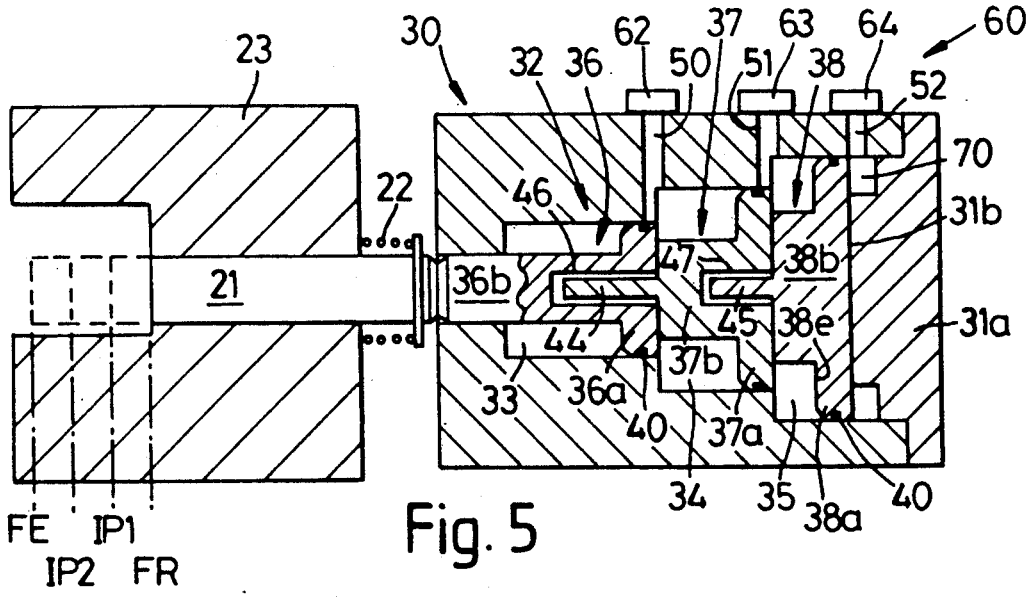
FIG. 5 is an axial section through the actuator shown in FIG. 4 which is diagrammatically illustrated mounted on a cam assembly.

An example of a pneumatically powered actuator 30 is illustrated in FIGS. 4 and 5.

The actuator 30 has a body 31 including a stepped bore 32. In the illustrated embodiment, the bore 32 includes a series of three distinct piston cylinders 33,34 and 35 each of which houses a piston 36,37 and 38 respectively. The body 31 is mounted on a cam assembly, shown schematically by numeral 23.

Each piston 36,37 and 38 in the series has a head portion **36*a*,37*a* and 38*a* respectively which sealingly engages with the wall of its associated piston cylinder. Preferably each head portion is provided with an elastomeric O-ring seal 40 for forming said sealing engagement. The bore is closed at one axial end by an end cap 31*a* which has an axial face 31*b* that engages piston 38** to act as an end stop.

Each piston 36,37 and 38 has a body portion **36*b*,37*b* and 38*b* respectively which is of reduced diameter. The body portions 37*b* and 38*b* have a diameter less than the diameter of the adjacent piston cylinders 33,34** respectively so that when positioned therein a gas chamber is formed for causing initial movement of the piston located in that cylinder.

Body **36*b* is of substantially the same diameter as through bore 42 and projects therethrough to the exterior of the body 31 to engage a bolt cam 21 to be moved. This is shown schematically in FIG. 5**.

Body **37*b* and 38*b* also have an axial shaft projection 44,45 respectively which slidingly project into blind bores 46,47 formed in piston bodies 36*b* and 37*b* respectively. Shaft projections 44,45 co-operate with their associated bore 46,47 to restrain axial twisting of the piston bodies 37*b* and 38*b*** during axial movement.

Three conduits 50,51, and 52 are provided in the body 31 for supplying pressurised air into the piston cylinders and for also enabling exhausting of air from the piston cylinders.

A valve assembly 60 is provided which is operable to selectively connect each conduit 50,51 and 52 to a supply of pressurised air for introduction of pressurised air into the cylinders or to atmosphere for venting of the cylinders.

The valve assembly 60 includes for each conduit 50,51 and 52 a valve slide 62,63 and 64 respectively which is moved between first and second positions by means of a solenoid. Each solenoid is electronically controlled, e.g. by a programmable computer, so as to be activated at appropriate times during each knitting cycle for knitting an article on the knitting machine.

To extend the body **36*b* (and thus bolt cam 21) from a fully retracted FR position to a fully extended position FE (FIG. 5**) via two intermediate extended positions IP1 and IP2 the following sequence is adopted.

Initially all slide valves 62,63 and 64 are positioned such that conduits 50,51 and 52 are vented. Biasing means 22 such as a spring acting on the cam bolt urges the piston assembly in the axial direction of retraction and since conduits 50,51 and 52 are vented the pistons 36,37 and 38 all reside in their fully retracted positions as shown in FIG. 5. As seen in FIG. 5, in the fully retracted position, the pistons are nested together with opposed axial faces in abutment. Accordingly, movement of a larger piston in the extend direction causes the remaining smaller pistons in the series to be moved in unison in the extend direction also.

Figure 5A:
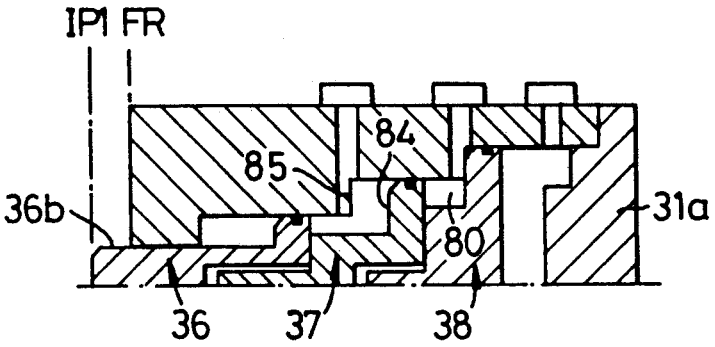
FIGS. 5*a* to 5*c* are schematic part similar to FIG. 5 showing the actuator at different stages of actuation.

To move body **36*b* to position IP1 valve slide 64 is moved to its operative position whereat it connects conduit 52 to the source of pressurised air. Initially air is supplied to chamber 70 which causes the piston 38 to move axially in the extend direction thereby causing movement in the extend direction of the entire rest of pistons 36,37 and 38 in the series between the chamber 70 and the cam element 21. After this initial movement the entire axial end face of piston 38 is exposed to the air pressure and the piston 38 continues to move in the extend direction until the axial face 38*e* of the piston 38 engages a shoulder at the forward end of cylinder 35. At this position body 36*b* has reached position IP1 and body 38*b* has entered cylinder 34 to create a chamber 80 for initialising movement in the extend direction of piston 37. (See FIG. 5*a***).

To move body **36*b* to position IP2, valve slide 64 remains in position to supply pressurised gas to cylinder 35 and valve slide 63 is moved to connect conduit 51 to the pressurised air supply. Accordingly pressurised air enters newly formed chamber 80**.

Figure 5B:
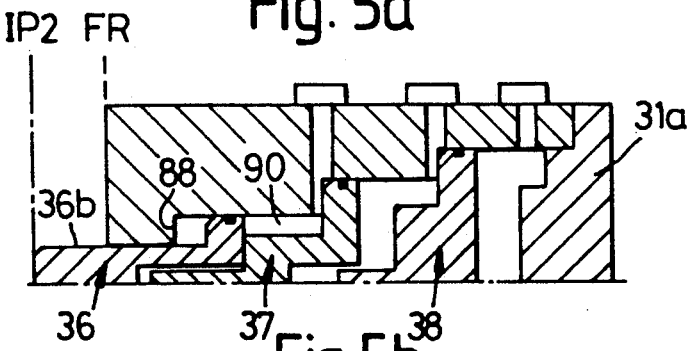

The air pressure in chamber 80 acts upon the axial end face of piston 37 and moves it axially in the extend direction and thereby also moves piston 36 which is in the series between the piston 36 and the cam element 21. The axial stroke of piston 37 is terminated when its axial end face 84 engages shoulder 85 at the forward end of cylinder 34. At this position, body **36*b* is located at position IP2 and the body 37*b* is located within cylinder 33 and defines a gas chamber 90. (See FIG. 5*b***).

Figure 5C:
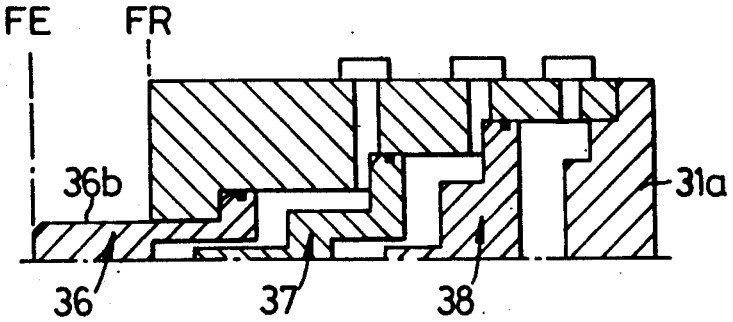

Advancement of body **36*b* to position FE is achieved by maintaining supply of pressurised air to cylinders 34 and 35 and operating valve slide 62 to connect conduit 50 to the pressurised air supply. The air pressure in chamber 90 acts upon the axial end face of piston 36 and moves it axially in the extend direction until its axial end face 87 engages shoulder 88 at the forward end of cylinder 33 whereat body 36*b* is located at position FE. (See FIG. 5*c***).

Advantageously, there is sufficient clearance between shaft projections 44,45 and blind bores 46,47 respectively to permit air to enter therebetween so that air pressure is applied across the entire cross-sectional area of each piston.

It will be appreciated that during the advancement stroke of each piston a constant advancement force is applied and so during advancement of the body **36*b* sufficient power is available to enable the body 36*b*** to advance to its next position.

It will be appreciated that by selective operation of valve slides 62,63 and 64 it is possible to move the body **36*b* to selected positions FE, IP2, IP1 or FR and hold the body 36*b*** thereat. Since the positions FE, IP2, IP1 and FR are each defined by engagement between opposed axial end faces these positions are accurately and positively provided by the construction.

An actuator for each bolt cam is provided at each knitting station around the peripheries of the cylinder assemblies.

The number of discrete axial positions provided by the actuator depends upon the type of bolt cam and so actuators providing 2,3 or 4 discrete positions will normally be provided.

It is envisaged that each body 31 will be directly mounted to the outside of an associated cam assembly and that a single air pressure supply pipe 50 (FIG. 4) be provided for supplying air pressure to each actuator associated with the upper cam assembly and a single air pressure supply pipe be provided for supplying air pressure to each actuator associated with the lower cam assembly.

Accordingly cam selections can be achieved by electronic control thereby providing the versatility of using electronics. In addition, the conventional cam wheel assembly and associated mechanical linkages can be dispensed with and directly substituted by actuators according to the present invention. This therefore enables existing machines to be simply modified and upgraded for electronic control.

It is envisaged that the electrical signals for activating the solenoids of the bolt cam actuators can be transmitted via a serial link and thereby substantially reduce the amount of wiring required.

Figure 6:
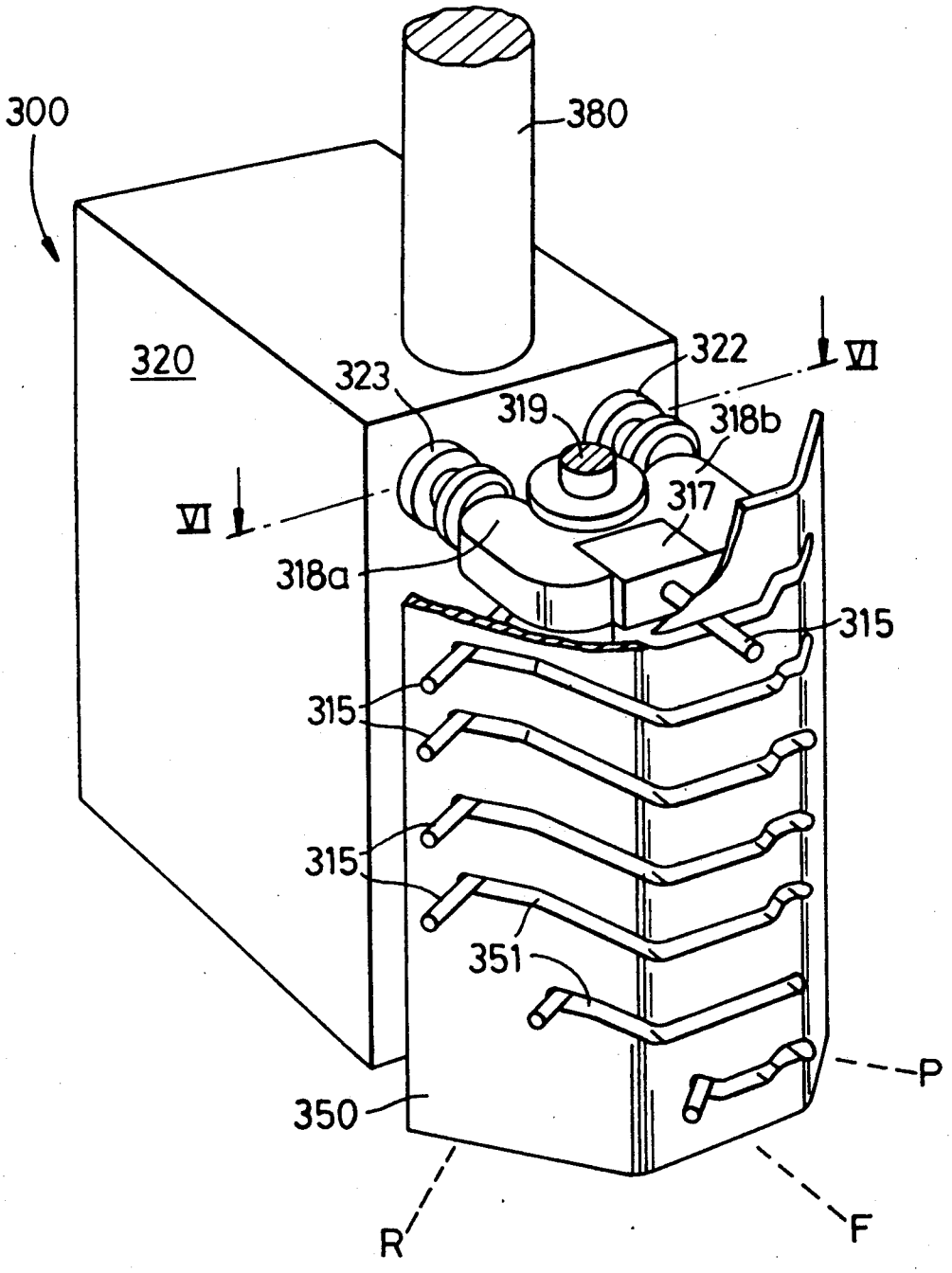
FIG. 6 is a perspective view partly broken away of an electronically controlled yarn feeder.

A suitable yarn feeder unit 300 is illustrated in greater detail in FIGS. 6 and 7. The feeder unit 300 enables different yarns to be fed at its associated knitting station and is pneumatically powered under electronic control to provide a compact unit which can be supported on the upper platform 100 without interfering with the upward movement of the platform 100.

The feeder unit 300 includes a plurality of yarn guide fingers 315 which are each arranged to move through an arc between three distinct positions to enable change over of feed of yarn from one yarn guide finger to another. The three distinct positions are rest position (R) whereat the yarn guide arm remains at one end of the arc in readiness to supply yarn; in this position the yarn is held in a trap; a feed position (F) whereat the yarn guide arm is located at an intermediate position in the arc and resides at this position to feed yarn to the needles; and a park/cross over position (P) at the opposite end of the arc whereat the yarn guide arm temporarily resides during change over. The arrangement of guides and sequence of movement for change over is known and reference should be made to UK Patent 2058152 B (U.S. Pat. No. 4,502,299) for fuller details.

In summary, the following sequence of movements are performed for changing over from a feeder A to a feeder B.

| Operation | Rest Position R | Feed Position F | Park/Cross-over Position P |
|---|---|---|---|
| Knitting with Feeder A | B | A | |
| Change over sequence: | | | |
| Step 1 | | B | A |
| Step 2 | | | A B |
| Step 3 | A | | B |
| Knitting with Feeder B | A | B | |

When knitting with the yarn from Feeder A, Feeder A is positioned at the Feed Position F and all the other Feeders are positioned at the Rest Position B. To change from Feeder A to Feeder B, Feeder A is swung to the Park Position P and Feeder B is swung into the Feed Position F. The Feeder B is then swung into the Park Position B and then the Feeder A is swung back to the Rest Position R. At the conclusion of the change over sequence the Feeder B is swung back to the Feed Position F and knitting resumes with the yarn from Feeder B, as described more fully in U.S. Pat. No. 4,502,299.

In accordance with the present invention to achieve movement of the guide fingers between the three distinct positions R, F and P each guide finger is acted upon by a first piston which moves the finger from one end of the arc to the other end and a two position stop means preferably in the form of a second piston which acts to arrest movement of the first piston at either the intermediate feed position or said other end of the arc. Preferably the first piston acts to move the associated yarn guide from the rest position R to the park/cross-over position P via the feed position F and biasing means, such as a spring acts to return the guide arm from the park/cross-over position P to the rest position R.

Accordingly, in the feed unit 300 illustrated in FIGS. 6 and 7 a piston cylinder block 320 is provided with a plurality of pairs of cylinders 321 for accommodating respective pairs of pistons 322, 323.

Each yarn guide finger 315 is mounted on respective boss 317 which is in turn pivotally attached to a support lever 318 having arms 318*a* and 318*b*. Each support lever 318 is mounted on a common shaft 319 secured to the cylinder block 320 (FIG. 6) so that deflection of each lever 318 about the axis of the shaft 319 causes the respective guide finger 315 to describe said arc. The pivotal connection between each boss 317 and support lever 318 extends perpendicularly to the axis of shaft 319 and enables each guide finger 315 to undergo a vertical displacement whilst the finger describes a horizontal arc.

A guide plate 350 is attached to the cylinder block 320 and each guide finger 315 projects through a respective guide slot 351 formed in the plate 350. Accordingly, the vertical position of each guide finger 315 is controlled and determined by the respective guide slot 351 during movement of the guide finger caused by deflection of its respective support lever 318.

Deflection of each lever 318 is achieved by a respective pair of co-operating pistons 322, 323 which respectively engage lever arms 318*b*, 318*a* located on opposite sides of the axis of shaft 319.

Piston 323 of each pair is arranged to have a stroke of extension to enable it to deflect the lever 318 so as to move the associated guide finger 315 from the rest position R through to the park/cross-over position P. Return movement of the lever 318 is achieved by means of a tension spring 340. The piston 322 when fully extended has a more limited stroke than that of piston 323 and thereby positively defines an intermediate position for lever 318. Piston 323 has a waisted portion 326 which defines an intermediate gas chamber 327 which communicates with cylinder 321. Accordingly, since both cylinders 321 are provided with the same gas source, the force of displacement on piston 323 is less than that on piston 322.

Accordingly, if both cylinders 321 are pressurised, piston 323 will deflect the lever 318 until it contacts piston 322 whereat further deflection is prevented since piston 323 is unable to overcome the counter force applied by piston 322. Since the fully extended position of piston 322 can be accurately manufactured, positive and accurate positioning of the lever 318 can be achieved.

Figure 7A:
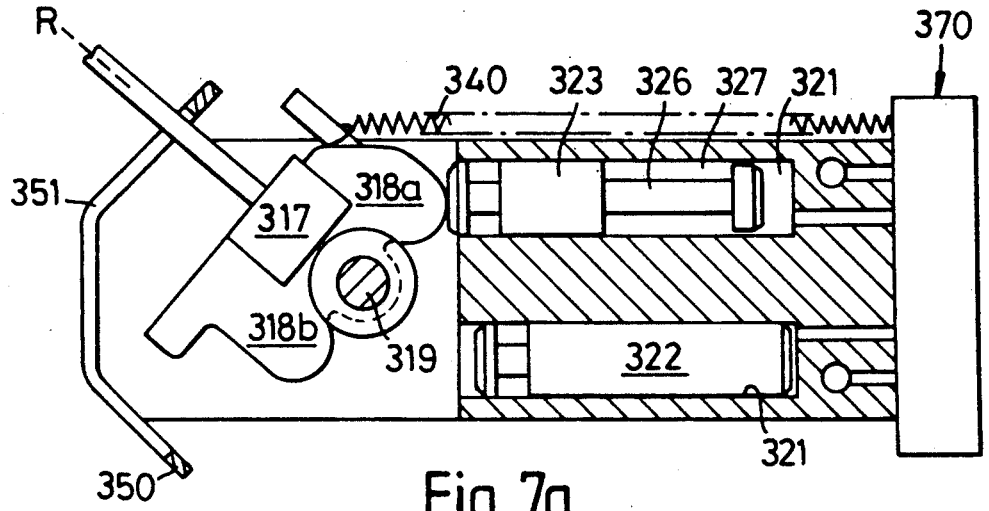
FIGS. 7*a* to 7*c* are each a sectional view along line VI—VI in FIG. 6 showing actuation of pistons for attaining different positions of a yarn guide finger.
Figure 7B:
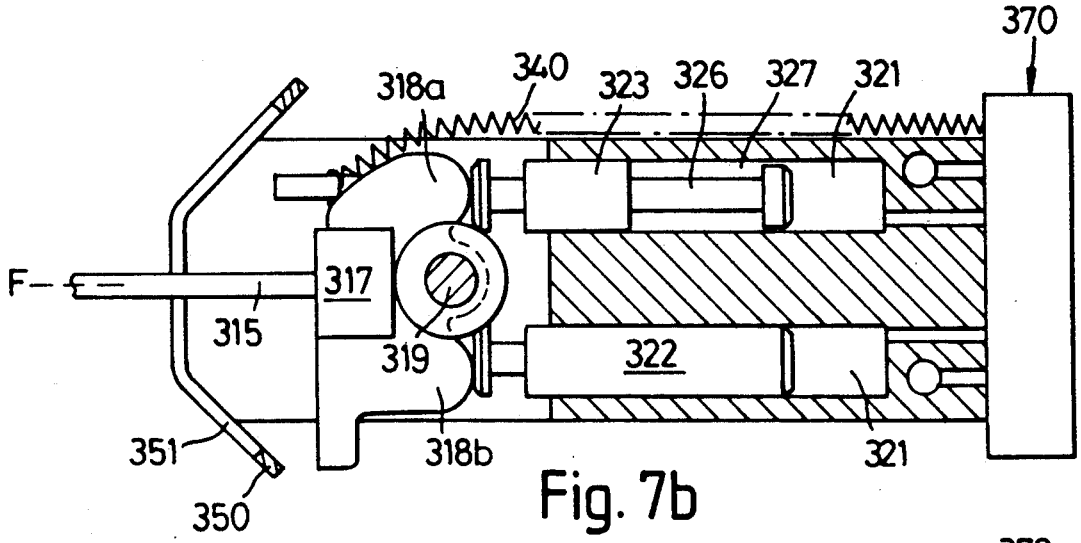
Figure 7C:
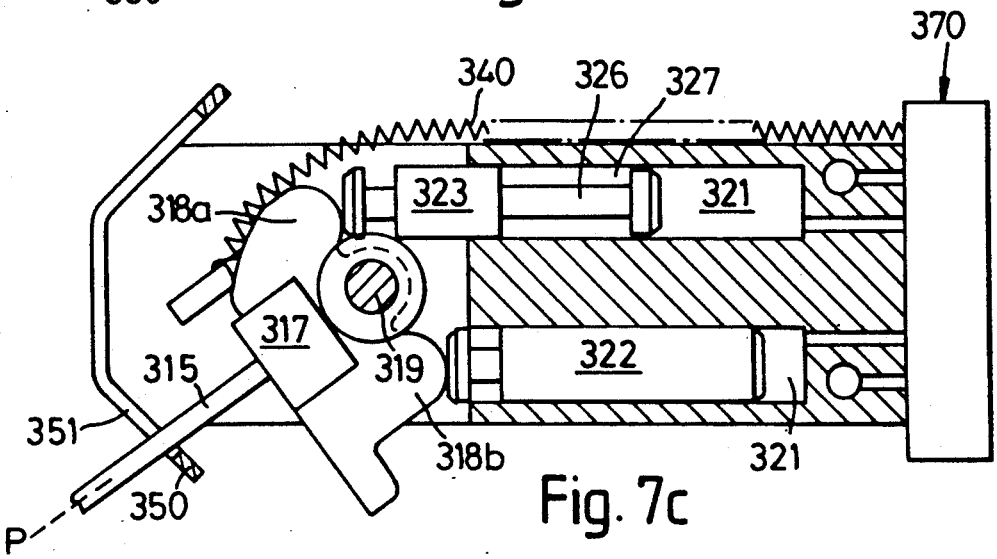

Fluid supply to the piston cylinders 321 is controlled by conventional solenoid operated valves 370 (shown schematically in FIGS. 7*a*–7*c*) mounted to the rear of the cylinder block. FIGS. 7*a*–7*c* illustrate the relative positions of pistons 322, 323 in order to achieve positioning of the guide finger at the rest position R, feed position F and park/cross=over position P respectively.

The valves 370 are operated in sequence to either supply pressurised gas to a cylinder 321 or to vent the cylinder.

The sequence is summarised below with reference to the positions R, F, P.

| Position | Piston 322 Cylinder | Piston 323 Cylinder |
|---|---|---|
| R* | Vent | Vent |
| F | Pressurise | Pressurise |
| P | Vent | Pressurise |

*Spring 340 holds the lever in this position.

The above construction provides a very compact arrangement which requires only a single supply of pressurised gas and electrical leads for controlling the solenoid operated valves 370. Accordingly, all mechanical linkages normally associated with conventional yarn feeders are eliminated. Conveniently the cylinder block is provided with a support shaft 380 which is attached to an arm 381 pivotally secured to the platform 100 (FIG. 1). In this way the yarn feeder device 300 can be conveniently pivoted between an operative working position (not shown) or as shown in FIG. 1 an inoperative position to provide access to the knitting cylinders or the yarn feeder unit itself. The arm 381 is retained in the operative position by means of a hand bolt 383 which engages in a slot 384 formed in the platform 100.

We claim:

1. A cam actuator for selectively moving cam elements axially between distinct operative positions, the actuator including a body having a stepped bore to define a series of piston cylinders, each piston cylinder housing a piston so as to provide a series of adjacent pistons arranged to be extended and retracted along the axial line of displacement of said cam element, stop means for limiting the axial stroke of each piston in the direction of extension, each piston co-operating with adjacent pistons in the series such that displacement of a given piston in the extend direction causes the remaining pistons in the series located between the cam element and the given piston to be displaced in the extend direction by the stroke length undergone by the given piston, each piston having a head portion in sealing engagement with its associated cylinder and having a reduced diameter body portion projecting in the extend direction to abut against the next adjacent piston in the series, the stop means for each piston being defined by a shoulder in said bore which defines the axial end of its associated cylinder, the reduced diameter body portion of a given piston being smaller than the diameter of the next adjacent cylinder in the series of piston cylinders such that on projection of said reduced diameter portion into said adjacent cylinder a fluid chamber is formed between said given piston and the next adjacent piston, and a fluid source for pressurizing in sequence each fluid chamber defined by each reduced diameter body portion and adjacent cylinder.

2. A cam actuator according to claim 1, including an electronically controlled valve between said source and each chamber to achieve selective pressurization or venting of the respective chambers.

3. A cam actuator according to claim 2, wherein a single valve is provided for each respective chamber for both supplying and venting of fluid to the respective chamber, the valve being mounted on the actuator body.

4. A cam actuator according to claim 1, including means to vent each chamber and means to bias the first piston in the series adjacent the cam element in the retract direction to cause retraction of all pistons in the series on venting of said chambers.

5. A cam actuator according to claim 1, wherein all pistons in the series beyond the first piston adjacent the cam element include an axial shaft projection projecting in the extend direction and received in a blind bore in the adjacent piston in the series closer to the cam element.

6. A cam actuator according to claim 1, wherein said series consists of three pistons.

7. A circular knitting machine including at least one cam assembly for controlling knitting action of the needles having at least one bolt cam and a cam actuator operatively connected to the bolt cam for causing displacement thereof along an axial line, the cam actuator including an actuator body having a stepped bore to define a series of piston cylinders, each piston cylinder housing a piston so as to provide a series of adjacent pistons arranged along the axial line of displacement, stop means for limiting the axial stroke of each piston in the direction of the bolt cam, each piston co-operating with adjacent pistons such that displacement of a given piston in the direction of the bolt cam causes the remaining pistons in the series between the bolt cam and the given piston to be displaced by the stroke length undergone by the given piston, each piston having a head portion in sealing engagement with its associated cylinder and having a reduced diameter body portion projecting in the direction of the bolt cam to abut against the neighboring piston, the stop means for each piston being defined by a shoulder in said bore which defines the axial end of its associated cylinder, the reduced diameter body portion of a given piston being smaller than the diameter of the adjacent cylinder in the direction of the bolt cam such that on projection of said reduced diameter portion into said adjacent cylinder a fluid chamber is formed between said given piston and the next adjacent piston, and a fluid source for individually pressurizing in sequence each fluid chamber defined by each reduced diameter body portion and adjacent cylinder.

8. A circular knitting machine according to claim 7, wherein an upper and lower cam assembly is provided, the upper cam assembly being mounted on an upper platform and the lower cam assembly being mounted on a lower platform, the upper platform being movably mounted on the lower platform for movement between a lowered operative position whereat the upper and lower cam assemblies co-operate for knitting and a raised in-operative position whereat the upper and lower cam assemblies are separated.

9. In a circular knitting machine having at least one knitting cylinder assembly, a cam actuator for selectively displacing cam elements axially between distinct operative positions at a knitting station on the periphery of the assembly, the actuator including a body having a bore housing a series of adjacent pistons arranged along the axial line of displacement, stop means for limiting the axial stroke of each piston in the direction of the cam elements, each piston cooperating with adjacent pistons such that displacement of a given piston in the direction of the cam elements causes the remaining pistons in the series located between the cam element and the given piston to be displaced in the direction of the cam elements by the stroke length undergone by the given piston, and a fluid chamber for each piston formed in the body between adjacent pistons for controlling displacement of the associated piston, each fluid chamber having an associated valve mounted on the actuator body for individually controlling flow of fluid into the fluid chamber and thereby controlling displacement of the associated piston relative to the adjacent piston in the direction away from the cam elements.

10. A cam actuator according to claim 9, wherein each chamber has an associated conduit and each valve is mounted on the body so as to cover the associated fluid conduit and includes a valve slide which in a first position communicates the fluid conduit with the source of pressurized fluid and which in a second position vents the fluid chamber.

* * * * *

UNITED STATES PATENT AND TRADEMARK OFFICE

CERTIFICATE OF CORRECTION

PATENT NO. : 5,187,951

DATED : February 23, 1993

INVENTOR(S) : Edward C. Stroud; John D. Griffith

It is certified that error appears in the above-identified patent and that said Letters Patent is hereby corrected as shown below:

Column 1, line 54, "a" should be --at--;

Column 3, line 8, after "schematic part" insert --illustrations--;

Signed and Sealed this

Twenty-eighth Day of December, 1993

*Attest:*

Bruce Lehman

BRUCE LEHMAN

*Attesting Officer*

*Commissioner of Patents and Trademarks*